United States Patent [19]

Kühn

[11] 4,043,405

[45] Aug. 23, 1977

[54] PILE-DRIVING ARRANGEMENT

[75] Inventor: Hans Kühn, Hamburg, Germany

[73] Assignee: Koehring GmbH, Ellerau, Germany

[21] Appl. No.: 632,424

[22] Filed: Nov. 17, 1975

[30] Foreign Application Priority Data

| | | |
|---|---|---|
| Nov. 16, 1974 | Germany | 2454488 |
| Nov. 16, 1974 | Germany | 2454521 |
| Aug. 30, 1975 | Germany | 2538642 |

[51] Int. Cl.[2] ..... B25D 9/00; E21B 1/00

[52] U.S. Cl. ..... 173/127; 173/133; 173/DIG. 1

[58] Field of Search ..... 173/DIG. 1, 127, 128, 173/133, 139; 175/6, 93

[56] References Cited

U.S. PATENT DOCUMENTS

| | | | |
|---|---|---|---|
| 1,846,804 | 2/1932 | Hansen | 175/6 X |
| 1,917,066 | 7/1933 | Schalscha | 173/127 |
| 2,827,263 | 3/1958 | Scott et al. | 175/93 |
| 2,904,964 | 9/1959 | Kupka | 175/6 |
| 3,096,831 | 7/1963 | Adams | 173/127 |
| 3,353,612 | 11/1967 | Bannister | 175/6 |
| 3,547,207 | 12/1970 | Warrington | 175/6 X |
| 3,596,722 | 8/1971 | Allard | 175/93 |
| 3,828,866 | 8/1974 | Jansz | 173/DIG. 1 |
| 3,881,557 | 5/1975 | Gendron et al. | 173/DIG. 1 |

FOREIGN PATENT DOCUMENTS

| | | | |
|---|---|---|---|
| 1,321,995 | 7/1973 | United Kingdom | 175/6 |

*Primary Examiner*—Lawrence J. Staab
*Attorney, Agent, or Firm*—Michael J. Striker

[57] ABSTRACT

The pile-driving arrangement can drive piles both above and below water. It includes a housing containing a gas-filled motion chamber and an impact body movable upward and downward in the motion chamber. A cylinder-and-piston mover includes a cylinder part and a piston part, one part connected with the housing and the other with the impact body, for effecting relative movement between the impact body and the housing. A drive unit on the housing includes a drive motor, a pump driven by the motor and a pressure fluid tank. The drive unit is connected with the housing for limited movement relative to the housing. The cylinder part and the pressure fluid pump are interconnected by flexible conduits leading from the pump to the opposite working chambers of the cylinder part, and a direction-changing device controls fluid flow through the conduits. The drive unit is buoyant and floats above the housing at a certain distance when the pile-driving arrangement is submerged, so that shocks are not communicated directly to the drive unit.

51 Claims, 8 Drawing Figures

PILE-DRIVING ARRANGEMENT

BACKGROUND OF THE INVENTION

The invention relates to a pile-driving arrangement for driving piles both below and above water. The arrangement includes a housing, a motion chamber in the housing, and an impact body guided for upward and downward displacement in the motion chamber. A pressure fluid cylinder is arranged on the housing or else on the impact body and contains a piston coupled with either the impact body or the housing, respectively. Pressure fluid conduits connect the pressure fluid cylinder with a pressure fluid source via a direction-changing device.

Federal Republic of Germany Offenlegungsschrift 1,955,300 discloses a pile-driving arrangement of this type connected via pressure fluid conduits with a power station located on land, on a ship or on a working platform, the abovewater power station furnishing driving fluid to the pile-driving arrangement. However, when pile-driving arrangements are used at great depths considerable difficulties arise. Long fluid conduits are needed. The low temperature of the surrounding water raises the fluid viscosity and makes for considerable friction losses, i.e., power losses. Additionally, the long fluid conduits due to their own weight and/or the effect of strong underwater currents can easily break, and in addition easily become caught on underwater objects.

SUMMARY OF THE INVENTION

It is a general object of the invention to provide a pile-driving arrangement which can be made to operate reliably and efficiently at great underwater depths without long pressure fluid supply conduits and which, furthermore, need not be designated to withstand high underwater pressures.

This object, and others explained below, can be met by mounting on the housing of the pile-driving arrangement a drive unit with at least one drive motor, at least one driving pressure fluid pump and a pressure fluid tank. The drive unit is connected with the housing through the intermediary of shock-absorbing devices and/or flexible tensile-stress-bearing elements for limited movability. The pressure fluid cylinder is connected with the pressure fluid pump and the pressure fluid tank via flexible pressure fluid conduits.

With the inventive pile-driving arrangement, the entire drive arrangement, including the pressure fluid pump and the pressure fluid tank, is mounted on the housing of the arrangement protected from shocks, to avoid the hitherto conventional pressure fluid supply tubes leading down from above the water surface, and to thereby make for a very short pressure fluid path and increased efficiency, irrespective of whether the pile-driving arrangement is used above water or at great underwater depths. The shocks occuring during pile-driving work, attributable particularly to the rebound energy of the elastically deformable pile when the pile is struck, are not transmitted directly to the drive unit, but instead are elastically absorbed by shock-absorbing devices.

Advantageously, the drive unit can be connected with the housing via elastically deformable shock-absorbing devices, particularly cushion members made of rubber or elastomeric synthetic plastic material. Alternatively, the shock-absorbing devices are each comprised of an hydraulic cushion and a cooperating hydraulic cylinder.

If the shock-absorbing devices are designed to include cooperating hydraulic cushions and cylinders, than the impact energy initially serves to cause pressure fluid to be forced into the hydraulic cushion against the rising pressure of the gas in the hydraulic cushion. As a result, there is produced a quick relative movement of the piston in the hydraulic cylinder, because only small amounts of pressurized oil and gas of low mass need be accelerated. During the course of such an in-stroke, the drive unit is accelerated by the energy of the compressed gas of the hydraulic cushion considerably slower until the compressed gas in the hydraulic cushion has expanded back to its original volume and has pushed back the pressurized oil in the hydraulic cylinder. In this way the short and hard shocks are converted into relatively soft, smooth movements.

In order that no undesired spring oscillation develop when the accumulated energy is released, the hydraulic cylinder is connected with the hydraulic cushion via a flow restrictor arrangement operative for slowing the flow of hydraulic fluid only in direction back to the hydraulic cylinder. The backflow of the pressure fluid out of the hydraulic cushion is throttled in such a manner that the in-stroke of the cushion piston occurs quickly due to the low masses to be set into motion, whereas the out-stroke occurs only relatively slowly due to the large mass to be accelerated in the drive unit. All in all, this results in an excellent shock-absorbing action for the purposes in question.

In the case of particularly hard shocks, resulting for example from the rebound following the striking of a very long pile or a pile which has met an obstruction and therefore cannot be driven further in, the in-stroke action would occur at a higher pressure level, because due to the higher impact energy the gas cushion in the hydraulic cushion device would be compressed to a greater extent and thus move the drive unit more forcefully.

If the hydraulic cylinder is connected with a further hydraulic cushion device, via a normally closed pressure-responsive valve which opens only when a certain pressure above the gas inflation pressure of the hydraulic cushion device is readied, then the storage capacity of the further hydraulic cushion device would be utilized only when a certain pressure is exceeded. This makes possible a greater in-stroke and accordingly an extension of the impact operation, limited only by the impact sequence of the pile-driving arrangement which will be so chosen that each impact is allowed to completely die away before the next impact upon the pile is made, so as to avoid superposition and resonance effects.

Advantageously, the gas bag of the hydraulic cushion device is selectively connectable, via a direction-changing valve, with either a pressurized gas tank maintained at a higher pressure or alternatively with an outflow conduit, with the setting of the direction-changing valve being changed each time the piston of the hydraulic cushion device reaches either of its end positions in the hydraulic cylinder and thereby activates associated switching contacts. Specifically, the gas pressure in the gas bag of the hydraulic cushion device is automatically increased when the piston reaches a predetermined upper end position. Conversely, gas is released from the gas bag of the hydraulic cushion device via the outflow conduit, when the piston reaches a predetermined lower end position. In this way, the starting position of the piston in the hydraulic cylinder and the spring characteristic of the hydraulic cushion device can be automatically matched in an optimal manner to the stress and shock requirements developing during different operating conditions.

Due to the independent variation of the storage volume of the hydraulic cushion device and the gas inflation pressure, relatively uniform shock loading and trouble-free operation even under difficult operating conditions will be achieved.

According to a preferred concept, there can be arranged between the hydraulic cylinder and the hydraulic cushion device a parallel combination of a check valve and a branch containing both a normally open pressure-responsive valve and a flow restrictor, with the hydraulic cushion device additionally serving as a storage for the hydraulic work piston of the impact body. A plurality of hydraulic cylinders can be connected to communicate with one another.

There can be advantageously arranged on the drive unit a buoyancy tank filled with gas, preferably air, at normal pressure or at overpressure, with the buoyant force of the tank being greater than the weight of the entire drive unit. The drive unit, provided with the buoyancy tank, is connected with the housing of the arrangement via flexible tensile-stress-bearing elements. Thus, when pile-driving work is done underwater, the drive unit will move up away from the housing of the pile-driving body and be maintained floating above the housing at a distance determined by the lengths of the tensile-stress-bearing elements. The lengths of the tensile-stress-bearing elements, and accordingly the distance at which the drive unit floats above the housing, can be selected to take into account the requirements of each particular intended use. The drive unit can be maintained at different distances above the housing to assure that, despite any rebound effects, the drive unit will not contact the housing. On the other hand, it is advantageous to keep the spacing between the drive unit and the housing small to minimize the lengths of the pressure fluid supply conduits.

Advantageously, the drive unit is mounted for shifting movement on a coaxially extending guide shaft at the upper side of the housing. To provide lateral support for the drive unit, use can be made of suitable shock-absorbing elements especially for inclined pile driving work.

When a pile is driven a certain distance into the bed of the body of water, after being struck once, the housing for the impact body will drop down a corresponding distance. The connection of the buoyant drive unit to the housing through the intermediary of the elastic tensile-stress-bearing elements assures that the drive unit will be pulled down relatively more slowly and smoothly. Furthermore, the upwardly acting shock, resulting from the rebound energy of the struck and thereby elastically deformed pile, is not transmitted by the flexible tensile-stress-bearing elements in the direction toward the drive unit.

When doing pile-driving work above water, the drive unit rests with its underside on elastic shock-absorbing devices supported on the upper side of the housing. When operating above water, it is possible to directly observe the effect of the pile-driving blows upon the pile-driving arrangement, and to make appropriate changes in the forces of the pile-driving blow and or the frequency of the blows and/or the spring characteristics of the shock-absorbing elements, in order to operate in a manner which is optimum for the particular conditions. In contrast, when doing pile-driving work underwater, it is difficult to make adjustments for the particular bottom characteristic, the form and lengths of the piles and the damping of the rebound attributable to the water resistance, because it is difficult to directly observe the pile-driving arrangement in action and because automatic monitoring arrangements which would feed information to the surface are expensive and very much susceptible to malfunction. In comparison, the protection against the effect of shocks afforded to the drive unit by the expedient of floating the drive unit at a small distance above the housing impact-body constitutes an extremely simple and economical solution to the problem. Downward shocks are slowed in their effectiveness by the elastic tensile-stress-bearing elements connecting the drive unit to the housing beneath the drive unit, whereas upward shocks are not transmitted to the drive unit at all. Because the drive unit anyway requires an outer casing to protect its components from mechanical damage, the extra cost involved in the provision of the buoyancy tank is very small.

The buoyance tank can have a structural strength corresponding to the underwater pressures to which it will be subjected at the depths at which it will be used. Alternatively, the buoyancy tank can be filled with pressurized air, to make possible a lighter construction for the tank; the buoyancy tank then will not be subjected to the difference between the underwater pressure and atmospheric pressure, but instead will be subjected to only a small pressure difference between the surrounding water and the pressurized air in the buoyancy tank. This is very advantageous, because lighter construction for the buoyancy tank makes the drive unit as a whole lighter. Accordingly, when working above water, the weight which must be supported on the top of the housing through the intermediate of shock-absorbing components will be kept relatively small.

If the buoyancy tank were filled, while still above water, with pressurized air at the pressure anticipated for the underwater working depth, then the buoyancy tank would still need to be of heavy construction to withstand high internal pressure, and the aforedescribed advantage would not come into being. Accordingly, the invention contemplates increasing the pressure of the pressurized air in the buoyancy tank during the descent of the pile-driving arrangement through the water. To this end, the buoyancy tank can be connected via a conduit with the upper end of an annular space in the housing for the impact body. The annular space can contain air at its upper end and at its lower end communicate with the ambient water. As the pile-driving arrangement is lowered, the ambient water pressure increases, and more and more ambient water enters the annular chamber through the bottom thereof. As a result the gas in the upper portion of the chamber is increasingly compressed and forced via the aforementioned conduit into the buoyancy tank. In this way, the air pressure inside the buoyancy tank will automatically increase in correspondence to the increasing ambient water pressure.

To limit the gas pressure in the buoyancy tank, the aforementioned conduit can be provided with a cutoff valve which automatically closes when a predetermined pressure is reached, to prevent further inflow of air and thus to prevent a further pressure rise. To prevent undesired stressing of the buoyancy tank when the pile-driving arrangement is lifted through the water towards the surface, the buoyancy tank can have an outflow opening provided with a check valve. In this way, the elevation in the internal air pressure of the buoyancy tank, relative to the ambient water pressure, will be limited to the pressure value corresponding to the spring force of the check valve. The check valve will stay closed only so long as the sum of the check-valve-spring force and the force corresponding to the ambient water pressure exceeds the force corresponding to the internal pressure of the buoyancy tank. Accordingly, as the pile-driving arrangement is lifted up through the water towards the surface, the excess gas in the buoyancy tank will be continuously released in correspondence to the decreasing ambient water pressure.

As indicated before, when doing pile-driving work above water, the drive unit will rest on the upper side of the housing for the impact body, supported by shock-absorbing means. If the shock-absorbing means is a gas cushion comprised of a gas cushion body containing an elastic gas-filled jacket, then, although the gas cushion may be properly soft and supportive above water, at great underwater depths the shape of the gas cushion will change and it will become hard; however, as explained before, underwater the drive unit will not rest on the housing but instead will float above the housing, and accordingly the change of condition of the gas cushion underwater will have no detrimental effect.

The housing for the impact body includes a motion chamber in which the impact body proper moves. Surrounding the motion chamber is an internal housing wall which is advantageously provided with at least one overflow conduit establishing communication between the upper and lower ends of the motion chamber. The overflow conduit is advantageously annular and surrounds the motion chamber, and communicates with the upper and lower ends of the motion chamber through a plurality of through-pass openings in the wall of the motion chamber. Thus, when the impact body descends, the gas in its path of motion can be pushed upward through the overflow conduit into the space above or back of the descending impact body; conversely, when the impact body rises, the gas in its path of motion can be pushed downward through the overflow conduit into the space below or back of the descending impact body. Advantageously, the upper through-pass openings are arranged at such a distance from the upper end of the motion chamber that they are closed off by the impact body during its upward movement shortly before it reaches its upper end position. As a result, there will build up in the motion chamber a gas cushion braking the upward movement of the impact body. The gas cushion serves, on the one hand, to slow the last portion of the upward movement of the impact body, and thereby prevent a hard impact against the upper wall of the housing, and, on the other hand, to quicken the first portion of the subsequent downward movement impact body. In this connection, it is advantageous to additionally provide a cutoff valve in the connecting conduit, with the cutoff valve closing during at least the last part of the upward movement of the impact body, for example under the control of the drive unit. Depending upon the requirements of particular intended uses, the impact body itself could be provided with at least one overflow conduit.

According to another preferred concept, the housing is provided with a housing chamber which at its lower end communicates via at least one opening with the surrounding water. This housing chamber communicates with the motion chamber for the impact body via a connecting conduit provided with a cut-off valve. When the pile-driving arrangements is lowered through the water, ambient water, with a pressure corresponding to the underwater depth, penetrates into the housing chamber at the bottom thereof and increasingly compresses the gas confined in the upper portion of the housing chamber. The increasingly compressed gas is forced via the connecting conduit into the motion chamber for the impact body. As a result, there will be automatically established in the motion chamber a gas pressure corresponding to the ambient water pressure. The housing chamber can have at its lower end an inflow conduit provided with a check valve which does not open until the outside pressure exceeds atmospheric pressure, an outflow conduit provided with a check valve which does not open until a predetermined overpressure has been established in the housing chamber, and a pump whose pressure side communicates with the housing chamber via a check valve and whose suction side communicates with the outside, to make it possible to elevate the pressure in the housing chamber and accordingly the gas pressure in the motion chamber above the level of the outside pressure.

Advantageously, the housing is provided with a guide casing which projects downward past the impact plate at the lower end of the motion chamber to surround the pile to be driven. The guide casing can be open at its lower end, so that when the pile-driving arrangement is lowered into the water the air initially present in the guide casing will form the gas cushion, and the guide casing accordingly form the lower end of the aforementioned housing chamber. Depending upon the intended uses, there also can be arranged beneath the impact plate a gas cushion enclosed by a flexible jacket. Advantageously, the housing chamber, in order to maximize its volume, extends down to the lower end of the guide casing. To facilitate dismounting of the impact plate and guide casing is advantageously secured on the housing in a releasable manner.

For the emplacement of the upper side of the impact plate, the housing can be provided with a downward facing abutment shoulder. Intermediate the abutment shoulder and the upper side of the impact plate there are advantageously provided one or more elastic annular seals. Additionally, the abutment shoulder can include an equlization conduit. The equilization conduit connects the annular spaces enclosed by the annular seals with the annular gap intermediate the housing and the peripheral surface of the impact plate. In this way, during the compression of the annular seals occurring after a blow upon the pile as a result of spring action, any water contained in the annular spaces enclosed by the annular seals can be driven out.

Advantageously, the impact plate contains at least one outflow conduit establishing communication between the interior of a pointed, hollow pile to be driven and the space surrounding the upper end of such hollow pile.

Above the impact plate, the housing can additionally have an upward facing annular shoulder provided with an annular seal and, spaced from the annular shoulder, a downward facing annular shoulder for an anvil arranged intermediate the impact plate and the impact body and cooperating with the impact body. The anvil can have an annular flange which abuts alternatively against one and then the other of these two annular seals.

The housing chamber, open at its bottom and having a volume equal to several times that of the motion chamber, makes it possible to automatically establish in the housing chamber and accordingly also in the impact body motion chamber a gas compression corresponding to the water depth, without the need for high-pressure-resistent construction of the housing and without the need for pressure fluid supply conduits leading to the surface of the water. When the housing chamber becomes filled with water, a float valve automatically closes the motion chamber preventing further entrance of water thereinto. Because the maximum underwater depth at which the arrangement can be safely used depends only upon the size of the housing chamber, it is in principle possible to so dimension the housing chamber so as to be able to operate at any depth whatsoever. Additionally, the motion chamber can be closed off independently of the water level in the housing chamber when the impact body begins to operate.

Greater water depths reached in the course of a ramming operation can be easily compensated, when the housing chamber is still incompletely filled, by opening the connecting conduit; the water column whose elevated pressure corresponds to the increased underwater depth forces additional gas into the motion chamber.

If the housing chamber has openings provided with check values and a pump sucking fluid in from the outside, then after the automatically occurring pressure equalization in correspondence to the water depth additional water can be pumped into the housing chamber, as a result of which the gas in the housing chamber and in the motion chamber will be compressed somewhat more than would correspond to the ambient water pressure. This prevents the penetration of water at the seals of the housing.

Due to the elevated gas pressure in the motion chamber, there could develop a non-constant loading for the pressure fluid circuit of the drive unit not occurring when operating above water. This is because the piston rod which moves the impact body downward, as it passes out through the transverse wall of the pressure fluid cylinder and into the motion chamber, must move against a higher gas pressure whereas, in contrast, when this piston rod returns into the pressure fluid cylinder during the subsequent lifting of the impact body, less force is required because of the gas pressure prevailing in the motion chamber. To avoid this difference in loading, the pressure fluid circuit at one location is separated from the ambient water only by a separating element which shifts or elastically yields with volume changes in the pressure fluid circuit. In this way, the pressure fluid lows to the pump of the drive unit with an initial pressure which is higher than normal, in correspondence to the prevailing pressure situation, to compensate for the aforementioned effect of the gas pressure in the motion chamber upon the piston rod, and thereby make it possible to keep the drive power substantially the same for both underwater and above water work.

If the pile-driving arrangement is to be used at very great underwater depths, the volume of the housing chamber may be insufficient, or the gas pressure in the motion chamber may rise to above the ambient water pressure as a result of an additional pumping of water into the housing chamber. In that event, there will develop a pressure difference between the gas pressure in the motion chamber and the ambient water pressure such as to require an improved sealing of the housing, if gas losses or penetration of leakage water is to be avoided. To this end, there can be provided, in addition to the impact plate, an anvil cooperating with the impact plate. The anvil has an outer annular flange. During pauses in operation, for example during lowering or lifting of the pile-driving arrangement through the water, the anvil with its annular flange will press against either an upward facing or a downward facing annular shoulder of the housing, depending upon the direction of the pressure drop. Thus, if the gas pressure in the motion chamber is the higher pressure, the anvil will press downward against the annular seal on the upward facing annular shoulder of the housing; if the ambient water pressure is the higher pressure, the anvil will press upward against the annular seal on the downward facing annular shoulder of the housing. By means of this additional sealing action, the danger of the downward escape of gas or the upward penetration of water during pauses in operation is decreased and the readiness of the arrangement for the resumption of operation and its efficiency in general accordingly improved.

If the piles which are being driven are hollow, then with each blow upon such a pile the pile is driven a certain distance into the bottom. As a result, when working underwater, the volume of the water-filled interior of the hollow pile decreases, after each blow, by an amount equal to the distance which the pile has penetrated during such blow multiplied by the cross-sectional area of the hollow interior of the pile. To avoid the added hardness of impact which would result if the corresponding excess of water could not escape during the pile-driving blow, some means must be present for permitting release of substantially all the excess water during the actual course of the blow, which may last for only a few thousandths of a second. If the means in question were simply escape openings in the walling of the pile, then in the case of hollow piles of large diameter such openings would have to be very large. The openings must be very large to assure that water can escape with the necessary volumetric flow rate, particularly when the bottom is relatively soft and the pile accordingly is driven a considerable distance each time it is struck. If the openings are not very large, then the energy put out by the drive unit in the performance of each blow upon the pile will be mostly consumed in the forcing of the excess water out of the interior of the hollow pile. On the other hand, since these outflow openings can be provided only in the walling of the hollow pile, there exists a very considerable danger that the resulting weakening of the walling will result in its deformation during the driving of the pile.

To avoid this difficulty, the invention contemplates providing the housing of the pile-driving arrangement with a guide casing surrounding the pile to be driven. As the pile-driving arrangement is lowered into the water, a considerable volume of air will be trapped below the annular guide casing, because the annular guide casing is open at its bottom so as to be able to be lowered down upon and surround the pile. This air will remain trapped inside the guide casing as the pile-driving arrangement is lowered to the water's bottom, and serve as a more or less compressed gas cushion located beneath the impact plate; this is because the seals with which the housing openings are provided and the substantially equal gas pressure in the motion chamber will prevent the air trapped in the guide casing from escaping. In this way, when the hollow pile is struck and driven into the water's bottom, the water to be forced out of the interior of the hollow pile can initially displace and compress the air of the just-described trapped air cushion. Then, after the blow, the displacing water can escape through relatively small openings provided in the walling of the hollow pile member, and the time available for such escape will be equal to virtually the full interval intermediate successive blows; this intermediate time interval will be longer by two or three orders of magnitude than the duration of each blow, so that the size of the escape openings can be correspondingly reduced. By providing an outflow conduit in the impact plate itself, the gas cushion surrounding the pile can be utilized as a gas accumulator volume. If the gas cushion in the interior of the pile is compressed to such an extent that the water level reaches the open end of the impact plate outflow conduit, then such internal water can be forced out through the outflow opening of the impact plate too. In this way it becomes possible to reduce the size and/or number of the escape openings provided in the walling of the hollow pile, or even to eliminate them altogether, without sacrificing the easy escape of water from the interior of the pile and the efficiency of the pile-driving arrangement. Additionally, the blow upon the impact plate involves sudden contact between substantially dry bodies, because there is no water in the motion chamber above the impact plate, and also inasmuch as there is a gas cushion beneath the impact plate.

However, if it should happen, that the water rises to such an extent as to enter into the space defined by the upper side of the impact plate and the elastic annular seals on the impact plate and water is trapped between these annular seals, and if no countermeasures are taken, then such water could prevent the occurrence of the proper cushioning action and even damage the annular seals. Specifically, upon the elastic rebound of the struck pile, the elastic annular seals serve to cushion the impact plate by elastically yielding. The presence of incompressible water intermediate the annular seals could prevent elastic compression of the annular seals and cause loss of the requisite cushioning action. Likewise, the incompressible water could exert a radially outward stress upon the annular seals causing them to shear. To prevent this from occurring, use is made of an equalization conduit which establishes communication between the annular spaces defined intermediate the annular seals, on the one hand, and the annular gap intermediate the housing and the impact plate, on the other hand.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
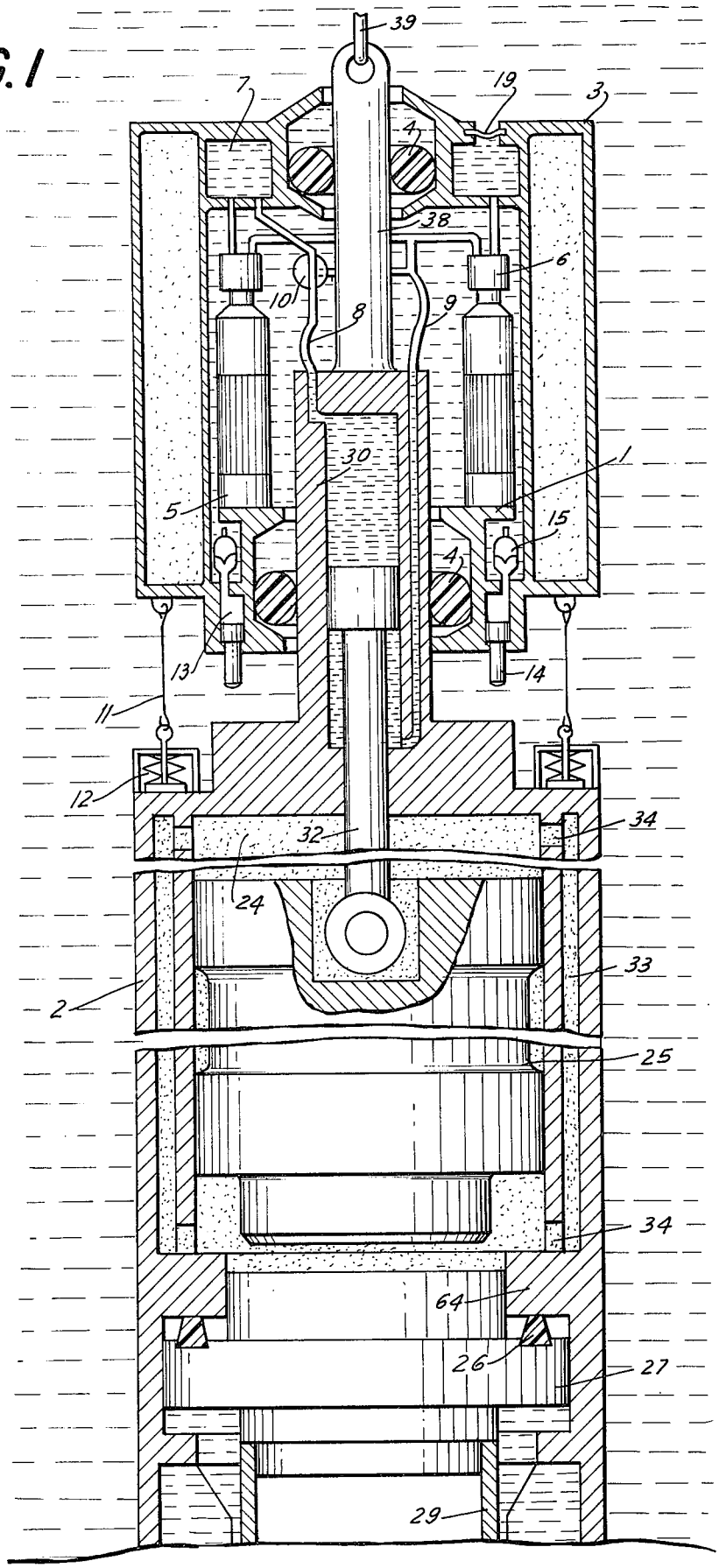
FIG. 1 is a partial longitudinal section through a pile-driving arrangement.

The pile-driving arrangement depicted in FIG. 1 includes a generally cylindrical housing 2 with a cylindrical motion chamber 24 for an impact body 25 mounted therein for upward and downward shifting movement. The housing 2 includes an impact plate 27 which closes off the motion chamber 24 at the bottom. The impact plate 27 rests upon a pile 29. Arranged intermediate the housing 2 and the impact plate 27 is an annular seal 26. Mounted on the upper end of the housing 2 is an axially upward projecting pressure fluid cylinder 30 in which is slidably guided a piston 31 whose piston rod 32 is coupled to the impact body 25. The gas which is compressed in the motion chamber 24 as a result of the movement of the impact body 25 can flow via one of the communication openings 34 and a overflow conduit 33 into the space behind the impact body 25.

The pressure fluid cylinder 30 is arranged in the interior of an axially extending guide shaft 38 located at the upper end of the housing. The housing 2 is suspended by a supporting cable 39 connected to the upper end of the guide shaft 38. Arranged above the housing 2 is a drive unit 1 which is guided shiftably upward and downward on the guide shaft 38. The drive unit 1 includes a plurality of hydraulic pumps 6 each driven by a drive motor 5, a pressure medium tank 7, and pressure fluid conduits 8, 9 connecting the pressure fluid cylinder 30 via a reversing device 10 with the hydraulic pumps 6, on the one hand, and with the pressure fluid tank 7, on the other hand.

In the walling of the pressure fluid tank 7 there is seal-tightly inserted a separating element 19. In the illustrated embodiment, the separating element 19 is an elastic membrane which is shiftable in dependence upon the pressure relationships prevailing with a volume change of the pressure fluid tank. By means of this separating element, which at its one side is exposed to the pressure fluid and at its other side to the ambient water, the pressure fluid in the pressure fluid tank 7 is always subjected to the prevailing water pressure. As a result, the pressure fluid is supplied to the hydraulic pumps 6 with a correspondingly increased initial pressure, and the picture rod 32 is caused to move into the motion chamber 24 by a force correspondingly increased relative to the normal operating pressure in the pressure fluid circuit.

The drive unit 1 additionally includes an annular buoyancy tank 3. Drive unit 1 is guided for sliding shifting movement by annular shock absorbing elements 4 made of elastically deformable material on the circumferential surface of the pressure fluid cylinder 30 and the guide shaft 38. Provided intermediate the upper side of housing 2 and the lower side of drive unit 1 are a plurality of flexible tensile-stress-bearing elements 11, having the form of cables in the illustrated embodiment. During pile-driving work underwater, the tensile-stress-bearing elements 11 hold the drive unit 1 floating above the housing 2 at a distance determined by the lengths of the tensile-stress-bearing elements 11 and prevent the drive unit 1 from floating up under the buoyant action of the buoyancy tank 3. In the illustrated embodiment, the tensile-stress-bearing elements 11 are connected with the housing 2 through the intermediary of elastically deformable cushioning elements 12, here designed as springs. Use can be made of either tension springs or compression springs, depending upon the needs of a particular application. Alternatively, the tensile-stress-absorbing elements 11 could be connected to the housing 2 through the intermediary of hydraulic cylinders communicating with hydraulic cushion elements.

When the illustrated arrangement is lifted out of the water, the drive unit 1 settles down onto the upper side of the housing 2, cushioned by means of hydraulic cylinders 13 arranged at the bottom side of the drive unit and cooperating with respective hydraulic cushions 15. The spring characteristics of the hydraulic cylinders 13 can be set to any desired value by means of the hydraulic cushions 15.

Figure 2:
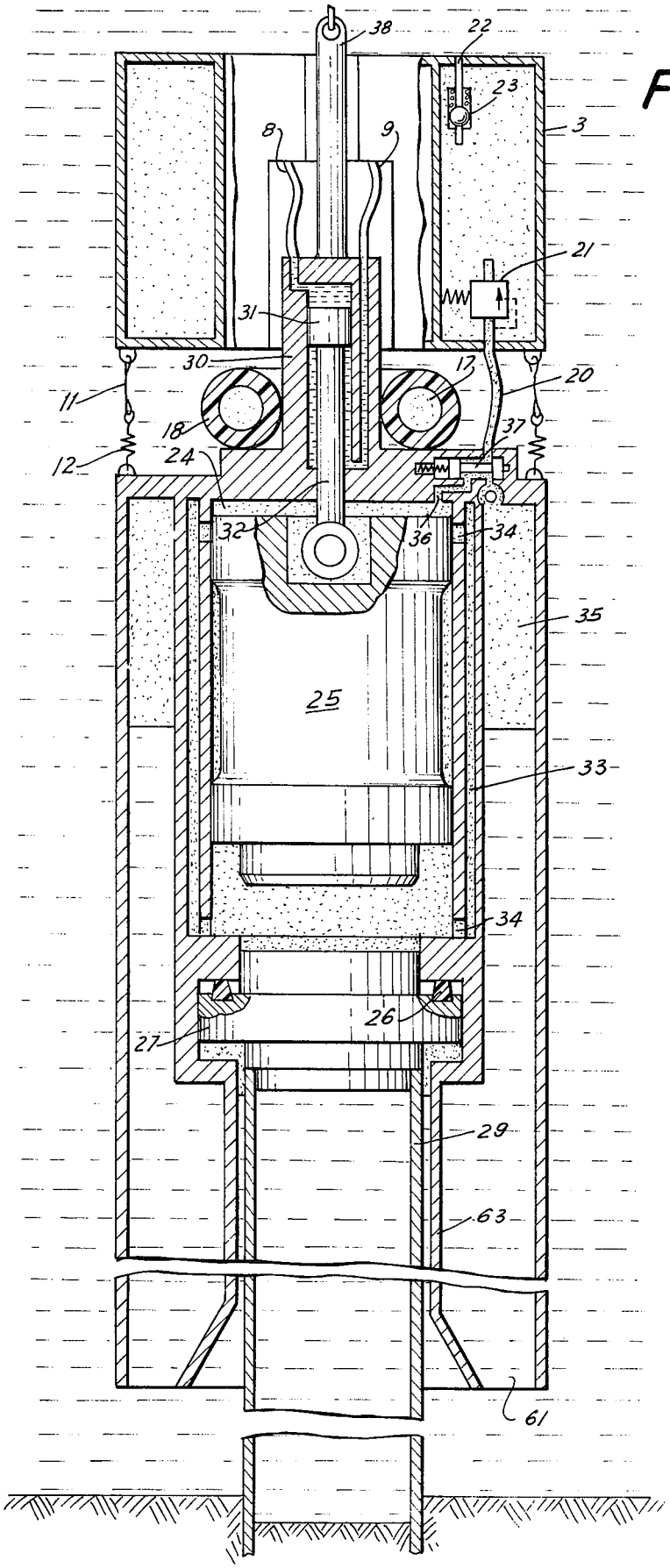
FIG. 2 is a longitudinal section through a modified pile-driving arrangement, with part of the pressure fluid unit removed for the sake of clarity.

The modified construction shown in FIG. 2 corresponds to a considerable extent with the construction of FIG. 1. However, in FIG. 2, the buoyancy tank 3 is connected, via a conduit 20 provided with a pressure-responsive cutoff valve 21, with the upper end of a housing chamber 35 arranged in the interior of housing 2. Housing chamber 35 communicates with the outside via openings 61 arranged at its lower end, and communicates with the motion chamber 24 for the impact body 25 through the intermediary of a connecting conduit 36 containing a cutoff valve 37. For lowering the drive unit down onto the housing 2, use is made not of the hydraulic pistons 14, but instead of a gas cushion body 18 arranged on the upper side of the housing 2. The gas cushion body 18 encloses a gas cushion 17 in a flexible jacket made of elastically deformable material.

With this design of the pile-driving arrangement, when the arrangement is lowered into the water, the ambient water pressure increased, and the water in housing chamber 35 rises thereby compressing the gas enclosed in housing chamber 35. The compressed gas flows, on the one hand, into the motion chamber 24 via the connecting conduit 36 and, on the other hand, into the buoyancy tank 3 via the conduit 20. As a result, the gas pressure prevailing in the buoyancy tank 3 will always correspond to the ambient water pressure, making unnecessary a pressure-resistant construction for the buoyancy tank 3.

Due to the provision of the connecting conduit 36, the pressure in the motion chamber 24 likewise corresponds to the ambient water pressure. When the rising water in the housing chamber 35 has formed the compressed gas therein into the motion chamber 24 and into the buoyancy tank 3, the cut-off valve 37 closes thereby preventing the entrance of water into the motion chamber. In a corresponding manner, the cut-off valve 21 in the conduit 20 closes when a predetermined pressure is exceeded in the buoyancy tank 3. In this way, the internal pressure in the buoyancy tank 3 can be set to a selected value which takes into account the structural strength of the buoyancy tank 3. The buoyancy tank 3 additionally includes an outflow opening 22 provided with a check valve 23. By means of the outflow opening 22, when the pile-driving arrangement is lifted towards the surface of the water, the overpressure prevailing in the buoyancy tank 3 is relieved in correspondence to the progressive decrease of the ambient water pressure. As a result, when the pile-driving arrangement emerges from beneath the water, the internal pressure of the buoyancy tank will correspond only to the spring pressure of the spring of check valve 23.

Figure 3:
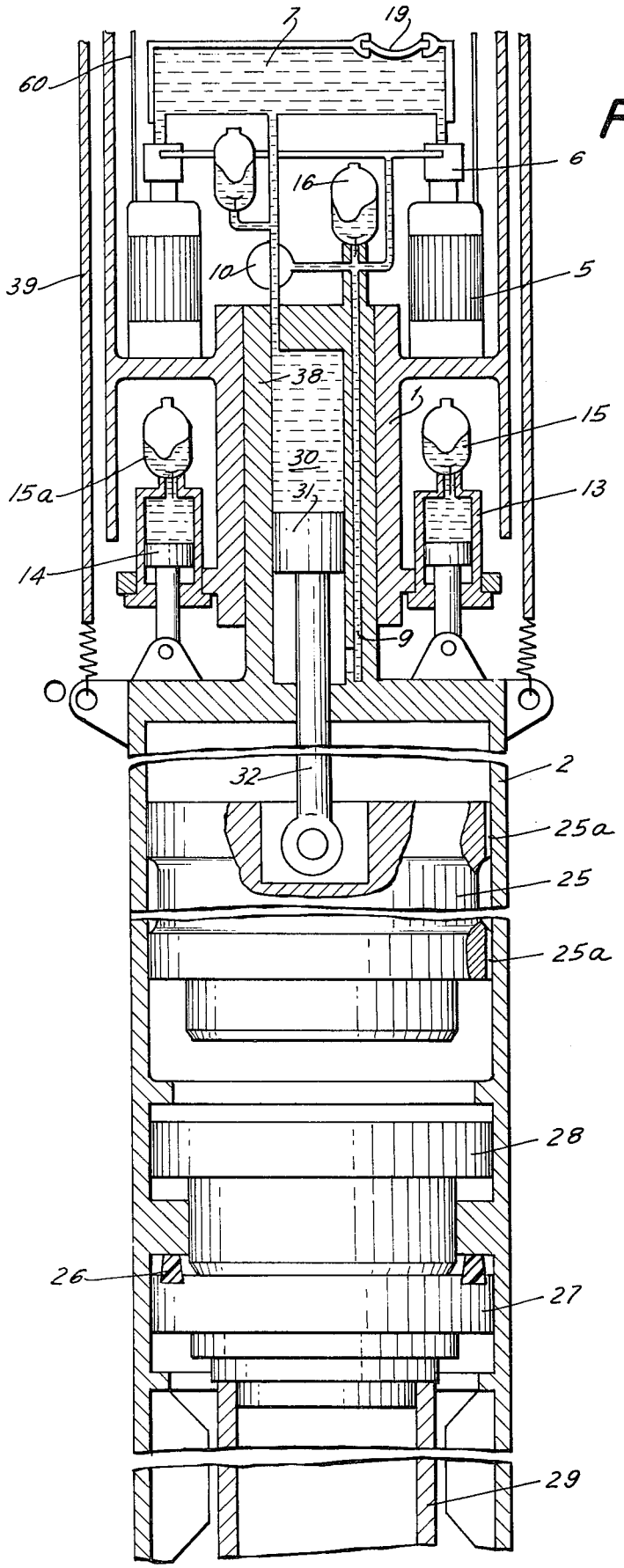
FIG. 3 is a partial longitudinal section through another pile-driving arrangement.

The pile-driving arrangement shown in FIG. 3 likewise includes a housing suspended by support cables 39 and an impact body slidably guided inside the housing. Arranged below the impact body 25 is an anvil 28 and beneath the latter an impact plate 27 which during the pile-driving work rests upon the pile 29. The impact plate 27 at the outer edge at its upper side has an elastic annular seal 26 which bears against an abutment shoulder 64 of the housing 2 for damping the rebound following each impact. At the inner side of the abutment shoulder 64 there is provided an annular seal cooperating with the circumferential surface of the anvil 28.

At the upper end of the housing 2 there is again provided a guide shaft 38 coaxial with the housing and accommodating in its interior the pressure fluid cylinder 30. The pressure fluid cylinder 30 is subdivided by a slidably guided piston 31 into a lower working chamber and an upper working chamber. The piston rod 32 of piston 31 passes seal-tight through a through-opening in the housing 2 and is coupled to the impact body 25. Impact body 25, at its upper and lower circumferential edges, is provided with overflow conduits **25*a*** which permit a flow around of the gas compressed by the moving impact body in a direction opposite to the direction of movement of the impact body.

The driving unit 1, slidably guided on and coaxial with the guide shaft 38, includes a pressure fluid tank 7, two hydraulic pumps 6 communicating with the tank 7 and driven by respective electromotors 5, as well as pressure fluid conduits 8, 9 leading to the working chambers of the pressure fluid cylinder 30 via a reversing device 10. The driving unit 1 is connected with the housing 2 via a plurality of hydraulic dashpot cylinders 13 in each of which is slidably guided a piston 14. Each hydraulic cylinder 13 communicates with an accumulator 15 containing an accumulator bag **15*a* filled with pressurized gas. The electromotors 5 are supplied with current via a thin electric cable 60.**

Figure 4:
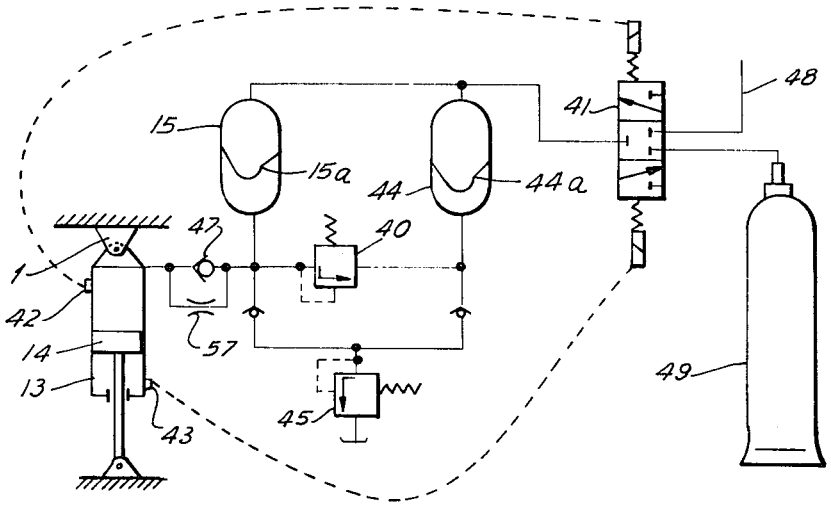
FIG. 4 depicts a hydraulic circuit arrangement for absorbing the shocks produced during operation of a pile-driving arrangement.

As depicted in FIG. 4, the hydraulic cylinder 13 is connected with the accumulator 15 through the intermediary of the parallel connection of a check valve 47 and a flow restrictor 57. For absorbing stronger pressure surges use is made of an additional accumulator 44. Accumulator 44 communicates with hydraulic cylinder 13 via a normally closed valve pressure-responsive valve 40 and also via the check valve 47 and/or the flow restrictor 57. Both accumulators 15, 44 are furthermore connected via check valves with a pressure-limiting valve 45. The accumulator bags **15*a*, 44*a* of the accumulators 15, 44 are connected, on the one hand, with a pressurized gas tank 49 containing gas under higher pressure through the intermediary of a reversing valve 41 and are connected, on the other hand, with an outflow conduit 48. The reversing valve 41 is normally in its illustrated blocking setting. Adjusting devices, shown in FIG. 4 in a very schematic manner, change the setting of reversing valve 41 under the control of switching contacts 42, 43 arranged at the ends of the hydraulic cylinder 13 whenever the piston 14 reaches its upper or lower end position. When the piston 14 reaches its upper and lower end positions, the accumulator bags 15***a*, 44*a* are connected to either the pressurized gas tank 49 or the outflow conduit 48, respectively.

Figure 5:
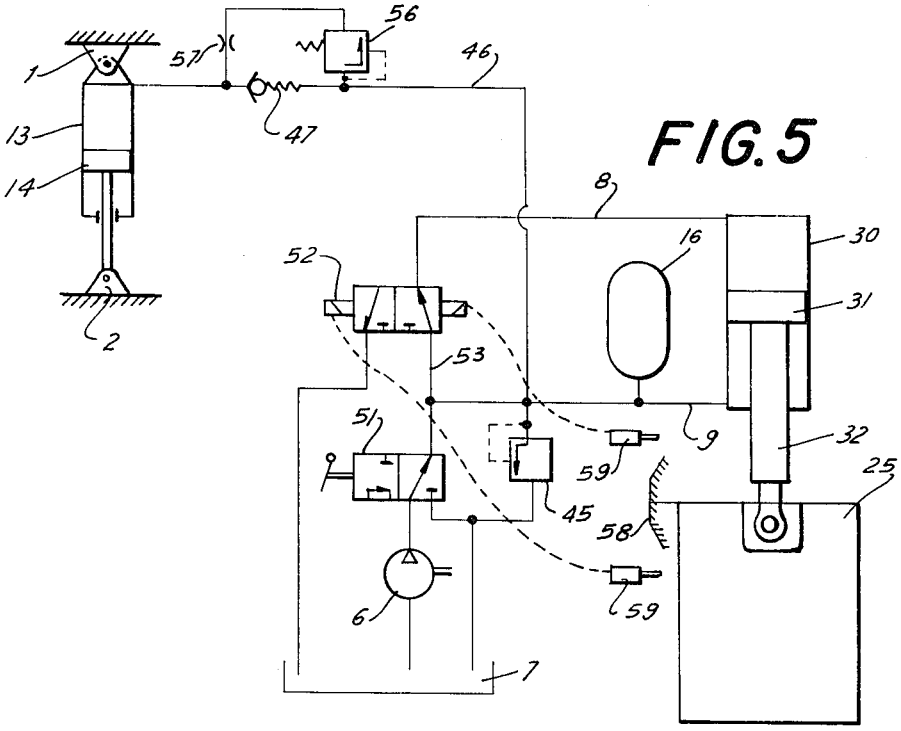
FIG. 5 depicts another such hydraulic circui arrangement.

In the arrangement shown in FIG. 5, the hydraulic cylinder 13 is connected with the accumulator 16 of the hydraulic driving arrangement for the impact body 25, through the intermediary of two parallel-connected branches, one of which contains a check valve 47 and the other of which contains the series connection of a normally closed pressure-responsive valve 56 and a flow restrictor 57. In this way the accumulator 16 additionally serves to cushion the driving unit 1. The pressure fluid sucked out of the pressure fluid tank 7 by the hydraulic pump 6 is supplied via the direction-changing valve 51 to the lower working chamber of the pressure fluid cylinder 30. The other direction-changing valve 52, in the setting thereof shown in FIG. 5, assures the flow of pressure fluid via the pressure fluid conduit 8 into the upper working chamber of the pressure fluid cylinder 30. Accordingly, the drive piston 31, operating on the differential pressure principle and due to its upper effective surface being greater than its lower by the amount of the piston rod cross-section, will move downward together with the impact body 25. The setting of direction-changing valve 52 is changed in dependence upon switching contacts 59 arranged in the path of travel of impact body 25 and activated by switching element 58, with the non-illustrated setting of valve 52 causing pressure fluid to flow out of the upper working chamber via the pressure fluid conduit 8 and via the direction-changing valve 52, to the pressure fluid tank 7.

Normally, the accumulator 16 serves to accept excess fluid when the pressure fluid stream continuously pumped by hydraulic pump 6 exceeds the fluid requirement of the cylinder and piston unit 30, 31. Due to oscillations of the piston 31 the fluid requirement will fluctuate slightly. Likewise, the accumulator 16 releases accumulated fluid during those times when the output of pump 6 does not reach the need of the cylinder and piston unit. It is to be noted that the accumulator 16 is always in communication with the lower working chamber of the pressure fluid cylinder 30, but in communication with the upper working chamber only during the downward piston stroke.

By suitably dimensioning the accumulator 16, the latter can, without any marked detrimental influence upon the drive action for the impact body 25, additionally serve to cushion the driving unit 1, if that the pressure in the pressure fluid cylinder 30 is set to a value somewhat lower than the normal average pressure in the accumulator 16. In the event of a rebound pressure surge, the pressurized oil forced out of the hydraulic cylinder 31 will be supplied via the pressure fluid conduit 46 and the spring-biased check valve 47 to the accumulator 16. Due to this additionally supplied pressurized oil, the pressure in the pressure fluid circuit remains elevated above the normal operating pressure until the effect of the rebound has died away.

Moreover, the play-out of the rebound pressure surge occurs during the phase in which the impact body 25 after its impact is to be upwardly accelerated, and the pressure elevation in the hydraulic system advantageously contributes an additional accelerating force. In this way a part of the rebound energy can be utilized for the accelerated lifting of the impact body 25, thereby increasing the efficiency of the pile-driving arrangement. After the rebound pressure surge has died away, pressure fluid flows into the hydraulic cylinder 13, via the normally closed pressure-responsive valve 56 and the flow restrictor 57, until the normal operating pressure in the hydraulic cylinder 13 has been reestablished whereupon the pressure-responsive valve 56 closes.

Figure 6:
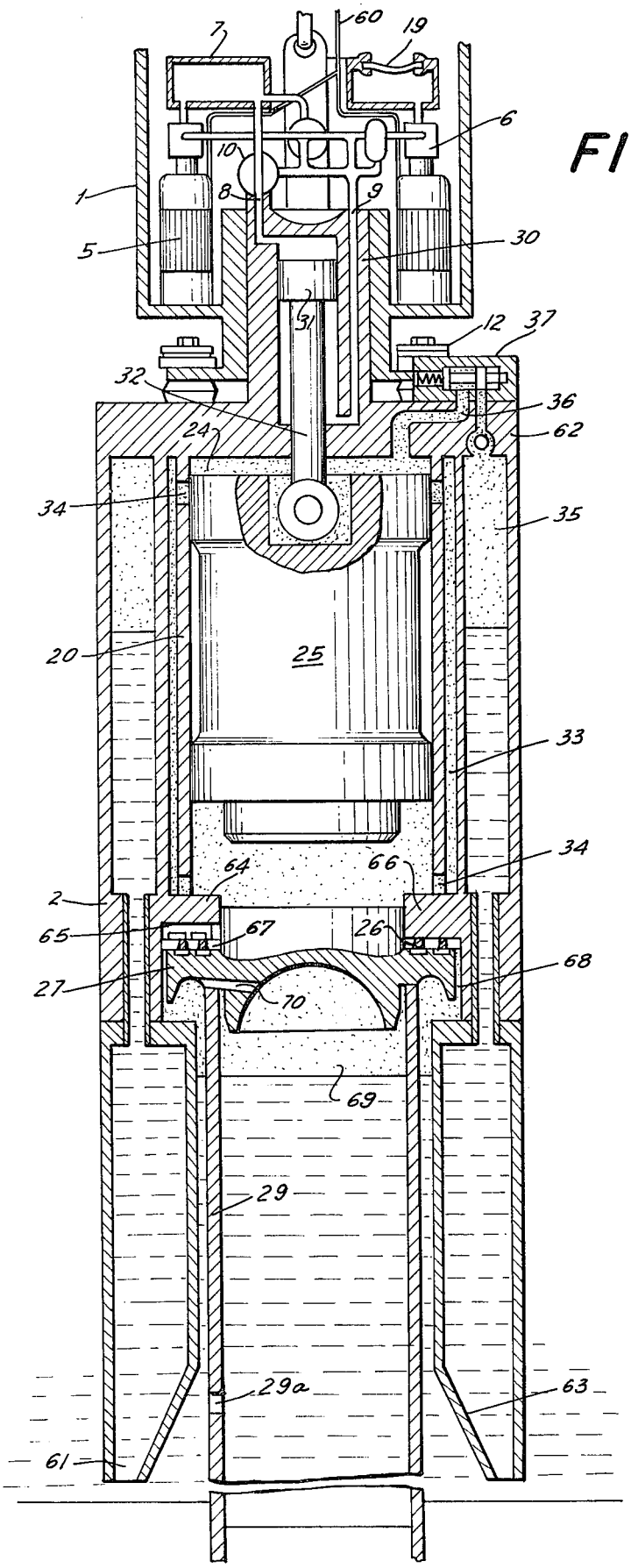
FIG. 6 is a longitudinal section through a further pile-driving arrangement.

The pile-driving arrangement shown in FIG. 6 includes a generally cylindrical housing 2 of double-wall construction containing an annular housing chamber 35 surrounding the cylindrical motion chamber 24. The annular housing chamber 35 at its upper end communicates with the motion chamber 24 via a connecting conduit 36 extending through the upper transverse wall of housing 2. The annular housing chamber 35 at its lower end communicates with the outside via openings 61.

The motion chamber 24 for the impact body 25 is closed off at its lower end by an impact plate 27 which rests upon the pile 29, here designed as a pointed hollow pile.

Integral with the upper transverse wall of the housing 2 is a coaxial guide shaft 38 containing a pressure fluid cylinder 30. Slidably guided in cylinder 30 is a piston 31 whose piston rod 32 passes through a through-opening in the transverse wall of the motion chamber 24. The through opening is provided with an annular seal, and the lower end of the piston rod 32 is coupled to the impact body 25 so that the piston 31 and impact body 25 are constrained to move up and down together. The drive unit 1, slidably guided on the guide shaft 38, is secured on the housing 2 by means of shock-absorbing cushion elements 12*a*. The drive unit 1, as before, includes hydraulic pumps 6 driven by an electomotor 5, with the hydraulic pumps 6 being connected via pressure fluid conduits 8 and 9 and a reversing device 10 located in the latter with a pressure fluid tank 7 and the working chambers of the pressure fluid cylinder 30. By suitably activating the reversing device 10, the pressure fluid pumped by the hydraulic pumps 6 is supplied to the working chambers of the differential-pressure cylinder 30. The effective surface area of the cylinder for downward movement of the piston to equal to the cross-sectional area of the piston rod 32.

The connecting conduit 36 at the end thereof communicating with chamber 35 is provided with a float valve 62, and it leads through a cut-off valve 37 which, in the illustrated embodiment, is controlled in dependence upon the hydraulic pumps 6 in such a manner as to be closed when pressure has built up in the pressure fluid circuit.

Separating the chamber 35 from the motion chamber 24 is an inner wall of the housing 2 containing an annular overflow conduit 33 which surrounds the motion chamber 24. The overflow conduit 33 communicates, via upper and lower communication openings 34, with the upper and lower parts of the motion chamber 24, respectively. The upper communication openings 34 are arranged somewhat below the upper end of the motion chamber 24 in such a manner as to be closed off by the impact body 25 during the upward movement of the latter shortly before impact body 25 reaches its upper end position.

Arranged on the housing 2 above the impact plate 27 is a downwardly extending guide casing 63. To facilitate removal of the impact plate 27, the guide casing 63 is removably mounted. The chamber 35 extends through the guide casing 63 to the lower end of the latter.

To support the impact plate 27 against the rebound force occurring after each impact due to the elastic deformation of the pile member 29, the housing 2 is provided with an annular abutment shoulder 64, the lower surface of which serves as a support for the elastic annular seal 26 arranged at the outer edge of the impact plate 27. Arranged in the abutment shoulder 64 is an equalization conduit 65 which connects the annular chambers 66, 67 surrounded by the annular elements 26 to the annular gap 68 intermediate the peripheral surface of the impact plate 27 and the housing 2. Mounted at the inner surface of the abutment shoulder 64 to seal the motion chamber 24 is an annular seal which seal-tightly lies against a peripheral surface of the impact plate 27.

As the pile-driving arrangement is lowered beneath the surface of the water, the water in housing chamber 35 rises in correspondence to the ambient water pressure at each submersion depth, and compresses the gas contained in the housing chamber 35, and accordingly also the gas contained in the motion chamber 24 communicating with chamber 35 via connecting conduit 36, to a pressure corresponding to the submersion depth. If the pile-driving arrangement is lowered to a depth such that the water reaches the upper end of the chamber 35, then the float valve 62 automatically closes the connecting conduit 36 and prevents entrance of water into the motion chamber 24. Until the depth is reached, there is always an exact correspondence between, on the one hand, the pressure of the gas compressed by the water in the still incompletely water-filled housing chamber 35 and also the motion chamber 24 and, on the other hand, the ambient water pressure. If after the closing of the float valve 62 the pile-driving arrangement is lowered further into the water, there will occur no further compression of the gas contained in motion chamber 24, so that from that depth down there will exist a difference between the internal and external pressures.

When the impact body 25 moves in the motion chamber 24, the gas compressed by the impact body 25 during its travel can always travel, in direction opposite to the travel direction of the impact body 25, through the overflow conduit 33 into the part of the motion chamber 24 located back of the impact body 25.

When working under water, the gas pressure prevailing in the motion chamber 24 resists the downward movement of the impact body 25 with a pressure force corresponding to the cross-sectional area of piston rod 32 but contributes to the lifting of the impact body 25 with a pressure force corresponding to the cross-sectional area of piston rod 32. This results in a non-constant loading of the pressure fluid circuit. For this reason, there is seal-tightly arranged in the walling of the pressure fluid tank 7 a separating element 19 here designed as an elastic membrane. Separating element 19 is exposed at its one side to pressure fluid and at its other side to ambient water and, depending upon the difference in pressures across its sides, it moves a corresponding distance into or out of the pressure fluid tank 7. In this way, the pressure fluid contained in the pressure fluid tank 7 is always subjected to the prevailing water pressure, so that such fluid is fed to the hydraulic pump 6 with a correspondingly increased initial pressure and the piston rod 32 is moved into the motion chamber 24 with a force correspondingly increased relative to the normal operating pressure. Because the gas compressed in the motion chamber 24 is likewise at the ambient pressure, the force increase just suffices to compensate the downward movement of the piston rod 32 by the amount of force corresponding to the gas pressure exerted upon its effective surface. Conversely, when the impact body 25 is being raised, the assisting gas pressure is compensated by the above-normal operating pressure in the pressure fluid circuit; as indicated before, the operating pressure exceeds the normal operating pressure by the amount of the ambient pressure.

Instead of a separating element 19 designed as an elastic membrane, there can alternatively be provided in the walling of the pressure fluid tank 7 for the same purpose a cylinder open at both ends with an internal piston subjected at one side to pressure fluid and at its other side to the water. In that case, the pressure fluid tank 7 can advantageously be connected with an hydraulic accumulator. The prestressed gas cushion of the accumulator would press the pressure fluid against the separating piston and hold the latter against the external water pressure in a floating position in the cylinder. Such a construction has the advantage that pressure fluctuations are smoothed out, and also the advantage that, in the event of any oil leakage losses in the pressure fluid circuit, the separating piston although it does in fact assume a lower position in the cylinder nevertheless does not lose contact with the pressure fluid.

When the pile-driving arrangement is lowered beneath the surface of the water, the air accumulating in the guide casing 63 forms a gas cushion 69 beneath the impact plate 27, so that when the impact plate 27 touches down upon the hollow pile member 27 compressed air corresponding to the water depth will be present both in the interior of the pile member and also in the annular space surrounding its upper end. An outflow conduit 70 in the impact plate 27 connects the annular space with the interior of the pile member 29. When the hollow pile member 29 is struck and driven into the bed of the body of water, the internal volume of the water-filled pile member 29 will abruptly decrease. The water to be forced out of the pile member can first compress the gas cushion 69 and then, during the entirety of the time interval between successive blows upon the pile, flow off into the annular space through the openings **29*a* arranged in the walling of the pile member 29, and possibly also via the outflow conduit 70. The annular space communicates with the ambient water through an annular gap located intermediate the outer surface of pile member 29 and the inner wall of the guide casing 63. If it should happen that the water has penetrated into the annular spaces 66, 67 enclosed by the annular seals 26, then the water can flow off through the equalizing conduit 65 to the annular gap 68 when the annular seal 26 becomes deformed due to the springback action of the elastically deformed pile member 29** after the blow.

Figure 7:
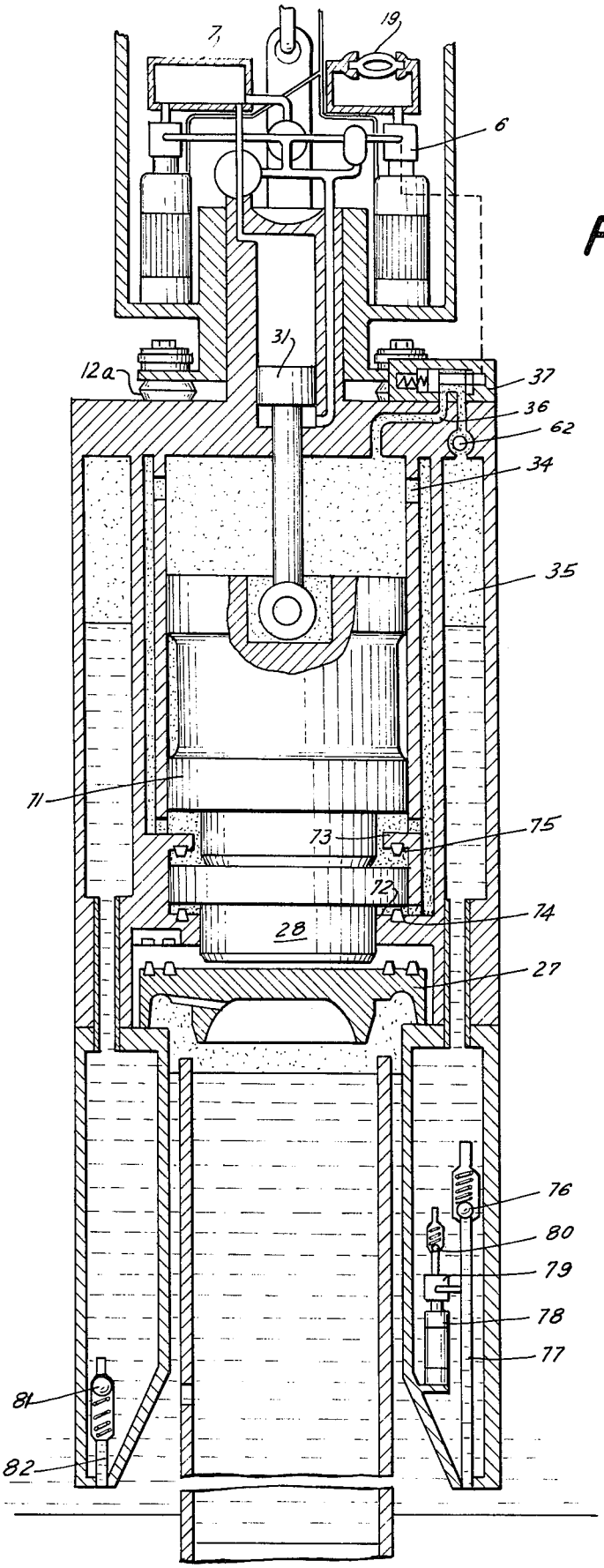
FIG. 7 is a longitudinal section through yet another pile-driving arrangement.

In the embodiment of FIG. 7, there is arranged between the impact body 25 and the impact plate 27 an anvil 28 which engages with an outer annular flange 71 between two annular shoulders 72, 73 arranged on the inner wall of the housing 2. The upward directed annular shoulder 72 supports a annular seal 74, and the downward directed annular shoulder 73 an annular seal 75. The annular seal arranged at the inner side of the abutment shoulder 64 in this case lies tightly against a peripheral surface of the anvil 28. In the position shown in FIG. 7, the anvil 28 with its annular flange 71 is pressed against the annular seal 74 of the shoulder 72 by the impact body 25 and the gas pressure prevailing in the motion chamber 24. As a result a supplemental sealing action is produced when the pile-driving arrangement is lowered or raised. On the other hand, if the external water pressure exceeds the gas pressure prevailing in the motion chamber 24, then the anvil with the upper shoulder surface of its annular flange 71 presses against the annular seal 75 of the annular shoulder 73 and likewise produces an additional sealing action.

The opening at the lower side of the housing chamber 35 is designed as an inflow conduit 77 provided with a check valve 76. The inflow conduit 77 is connected with the suction side of a pump 79 which pumps fluid into the housing chamber 35 via a check valve 80. There is also provided an outflow conduit 82 containing a check valve 81, with the closing force of the check valve 81 being greater than the closing forces of check valves 76 and 80. With this construction, when the pile-driving arrangement is lowered, water will initially flow through the inflow conduit 77 and the check valve 76 into the chamber 35 until the pressure equalization is established. Thereafter, by means of a pump 79 driven by a submersible electromotor 78, water can be sucked through the inflow conduit 77 and forced into the housing chamber 35 via the check valve 80, as a result of which the gas in the upper part of the chamber 35 and in the motion chamber 24 reaches a pressure higher than the water pressure corresponding to the submersion depth. In this way, particularly at the annular seal arranged in the abutment shoulder 64, the overflow of pressurized air from the gas cushion 69 into the motion chamber 24 is precluded, and any water which may happen to be present at the moment when the elastic annular seal 26 is compressed is prevented from being forced into the motion chamber 24 by the pressure building up in the decreasing space 67.

The pump 79 and the electromotor 78 can alternatively be arranged externally of the housing chamber 35, in particular mounted on the drive unit 1 and protected from shocks by suitable means, and be connected with the chamber 35 via a flexible conduit provided with a check valve.

When the pile-driving arrangement is lifted, water flows via the check valve 81 and the outflow conduit 82 out of the housing chamber 35. The closing force of the spring-biased check valve 81 limits the magnitude of the overpressure which can be reached in the housing chamber 35. Due to the closing force of the spring of the check valve 81, when the lifting arangement is lifted out of the water, there remains in housing chamber 35 a small amount of water, which can be caused to run off by manually opening a cock or a screw-plugged runoff opening. Check valve 81 could be replaced by a pressure-controlled cutoff valve controlled by the pressure in housing chamber 35 and a safety valve.

To soften pressure shocks in the pressure fluid circuit, there is provided in the walling of the pressue fluid tank 7 a separating element 19', here designed as a double membrane confining an intermediate gas cushion.

Figure 8:
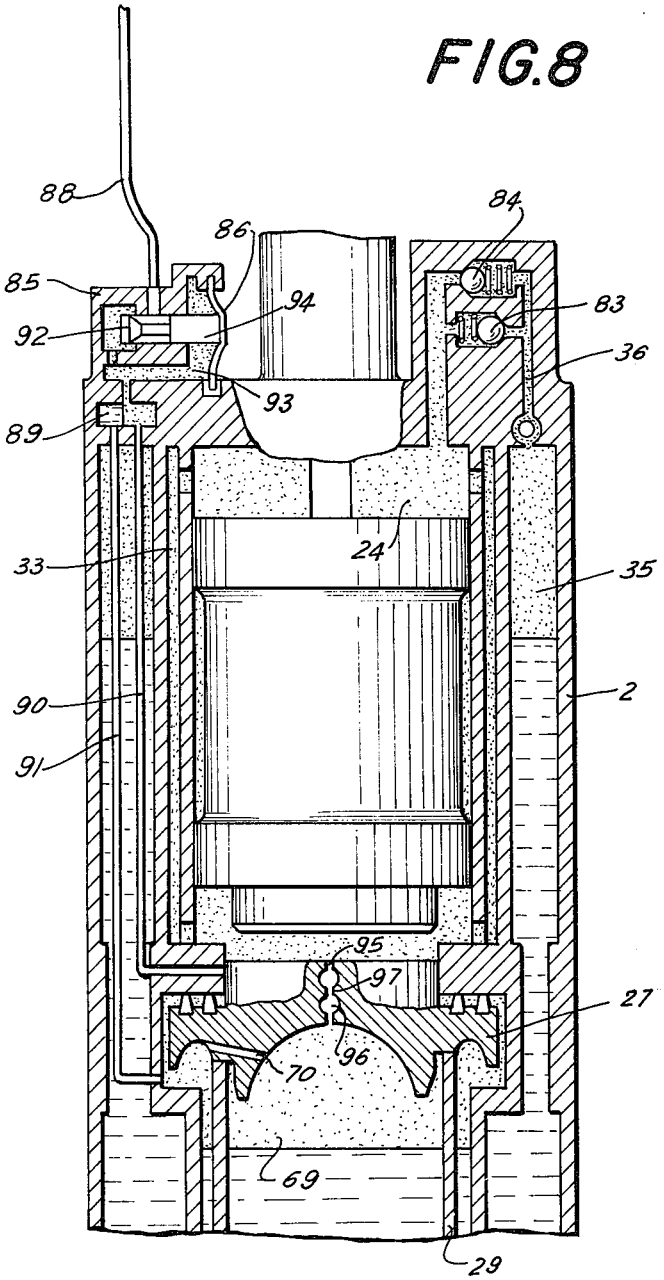
FIG. 8 is a longitudinal section through yet a further pile-driving arrangement.

In the embodiment of FIG. 8, there are arranged in the connecting conduit 36 two parallel check valves 83, 84 which pass fluid in opposite respective directions. Check valve 83 permits the gas compressed in chamber 65 during lowering of the pile-driving arrangement to overflow into the motion chamber 24 until pressure equalization occurs, and it closes as soon as the gas pressure in the motion chamber 24 is higher than in the housing chamber 35. The valve member of check valve 84 is pressed into its closed position by means of an adjustable spring device and, when the pile-driving arrangement is lifted up through the water, check valve 84 permits gas to flow out of the motion chamber 24 and into the housing chamber 35 as soon as the pressure prevailing in housing chamber 35 drops below the pressure in motion chamber 24 by the amount of a predetermined pressure difference.

To prevent water from penetrating forward to the impact plate 27, the housing 2 is additionally provided with a water-pressure-controlled cutoff valve 85. Cutoff valve 85 is connected, on the one hand, with a source of pressurized gas via a pessurized gas conduit 88 and, on the other hand, via a direction-changing valve 89 with a pressurized gas conduit 90 leading to the motion chamber 24 and also with a through-pass conduit 91 leading to the annular space underneath the impact plate 27. The source of pressurized gas can be a pressurized gas tank arranged on the housing 2 or on the drive unit. Alternatively, the thin pressurized gas conduit can be incorporated into the electrical cable 60 of the drive motor 5 and connected with a pressurized gas source located above water.

The pressure-responsive cutoff valve 85 includes a membrane 86 exposed at its one side to external pressure and at its other side to the gas pressure in a pressurized gas chamber 93 connected to the pressurized gas conduit 90, a sliding piston 94 connected to the membrane 86 and guided in the valve housing, and a valve member 92. As the external pressure rises, the membrane 86 and accordingly the sliding piston 94 will be shifted against the gas pressure in the pressurized gas chamber 93 and the valve body will move away from its valve seat. As a result, gas will flow out of the pressurized gas conduit 88 through the direction-reversing valve 89 and, depending upon the setting of the latter, through the pressurized gas conduit 90 and into the motion chamber 24 or else through the through-pass conduit 91 and the outflow conduit 70 into the gas cushion 69. The cutoff valve 85 advantageously can be so adjusted as to maintain the gas pressure in motion chamber 24 somewhat higher than the outside pressure.

When the pile-driving arrangement is being lowered through the water, the direction-changing valve 89 will be in the setting thereof in which it connects the cutoff valve 85 via the pressurized gas conduit 90 with the motion chamber 24. When the impact plate 27 touches down upon the pile 29, the impact plate will be shifted upward until the annular seal 26 abuts against the abutment shoulder 64 and thereby closes that end of the pressurized gas conduit 90 which opens into the motion chamber 24. The pressure head which builds up as a result in the pressurized gas conduit 90 can serve, on the one hand, to indicate that the impact plate has touched down upon the pile and that the pile-driving arrangement is ready for operation and, on the other hand, to cause a moving means of per se known construction to move the direction-changing valve 89 into the setting thereof in which the latter connects the cutoff valve 85 with the gas cushion 69 via the through-pass conduit 91.

Provided in the impact plate 27 is a small-diameter bore connecting the motion chamber 24 with the gas cushion 69. The bore includes a plurality of narrow flow restrictor sections 97 alternating with accumulator chambers 96 of considerably greater diameter. Accordingly, pressure fluctuations produced in the motion chamber 24 by the movements of the impact body 25 do not penetrate through to the gas cushion 69; instead the water surface beneath impact plate 27 is maintained relatively calm, but sufficiently spaced from the impact plate 27.

Only relatively small amounts of gas are supplied via the pressurized gas conduit 88, just enough to make up for gas losses resulting from release of gas into the ambient water and other causes, and accordingly the pressurized gas conduit 88 can be made relatively thin and incorporated into the electrical cable 60 for the drive motor 5.

With this design, if the pile-driving arrangement is lowered through the water quickly, the large amounts of gas needed to build up the requisite gas pressure in the motion chamber 24 are taken from the chamber 35 via the connecting conduit 36, and during operation small gas losses which may occur are made up for via the pressurized gas conduit 88.

The pile-driving arrangement may not include a chamber 35 disconnectably connected to the motion chamber 24 for automatic compression of gas using the ambient water pressure; in such event the motion chamber 24 can be filled with gas via the pressurized gas conduit 88 when the pile-driving arrangement is being lowered.

It will be understood that each of the elements described above, or two or more together, may also find a useful application in other types of constructions differing from the types described above.

While the invention has been illustrated and described as embodied in particular pile-driving arrangements, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A pile-driving arrangement for driving piles both above and below water, comprising, in combination, a housing containing a gas-filled motion chamber; an impact body movable upward and downward in the motion chamber; a cylinder-and-piston mover comprised of a cylinder part and a piston part, one part being connected with the housing and the other part with the impact body for effecting relative movement between the impact body and the housing; a drive unit on the housing, the drive unit including a drive motor, a pressure fluid pump driven by the drive motor, and a pressure fluid tank; connecting means connecting the drive unit with the housing for limited movability relative to the housing, and including means for resisting movement of the drive unit relative to the housing in at least one vertical direction; and means interconnecting the cylinder part and the pressure fluid pump including flexible conduits leading from the pump to the opposite working chambers of the cylinder part and a direction-changing device for controlling fluid flow through the conduits.

2. The arrangement defined in claim 1, wherein the means for resisting movement of the drive unit relative to the housing in at least one vertical direction comprises shock-absorbing devices for resisting movement of the drive unit toward the housing.

3. The arrangement defined in claim 1, wherein the means for resisting movement of the drive unit relative to the housing in at least one vertical direction comprises tensile-stress-bearing elements for resisting movement of the drive unit away from the housing.

4. The arrangement defined in claim 1, wherein the means for resisting movement of the drive unit relative to the housing in at least one vertical direction comprises shock-absorbing devices for resisting movement of the drive unit toward the housing and tensile-stress-bearing elements for resisting movement of the drive unit away from the housing.

5. The arrangement defined in claim 1, wherein the drive unit is mounted on the upper side of the housing guided for upward and downward shifting movement relative to the housing.

6. The arrangement defined in claim 2, and including elastically deformable shock-absorbing elements shiftably guiding the drive unit for upward and downward shifting movement relative to the housing.

7. The arrangement defined in claim 6, wherein the housing is provided with an upwardly extending guide shaft having a hollow interior constituting the cylinder part of the cylinder-and-piston mover, and wherein the shock-absorbing elements are annular elements guiding the drive unit for axial shifting movement on the guide shaft and located intermediate the peripheral surface of the guide shaft and the drive unit.

8. The arrangement defined in claim 1, wherein the drive unit includes a buoyancy tank having a buoyant force in excess of the weight of the entire drive unit, so that when the pile-driving arrangement is submerged the drive unit will float up away from the housing, and wherein the connecting means includes flexible tensile-stress-bearing elements connecting the drive unit to the housing for limiting the height at which the drive unit floats above the housing.

9. The arrangement defined in claim 8, wherein the tensile-stress-bearing elements are elastic in the direction of the tensile stress they bear.

10. The arrangement defined in claim 8, wherein the tensile-stress-bearing elements connect the drive unit to the housing through the intermediary of elastically deformable cushioning elements.

11. The arrangement defined in claim 2, wherein the shock-absorbing devices each include at least one elastically deformable cushioning element.

12. The arrangement defined in claim 2, wherein the shock-absorbing devices each include at least one gas cushion body containing a gas-filled jacket.

13. The arrangement defined in claim 2, wherein the shock-absorbing devices comprise hydraulic cushions communicating with the cylinders of hydraulic cylinder-and-piston cushion devices.

14. The arrangement defined in claim 13, wherein at least one of the shock-absorbing devices includes a unidirectional flow restrictor connecting the associated hydraulic cushion to the cylinder of the associated cylinder-and-piston cushion device.

15. The arrangement defined in claim 13, further including an auxiliary hydraulic cushion and a normally closed pressure-responsive valve which establishes communication between the additional hydraulic cushion and the cylinder of one of the cylinder-and-piston cushion devices in response to pressures exceeding the gas inflation pressure of the main hydraulic cushion.

16. The arrangement defined in claim 13, the hydraulic cushions being comprised of gas bags, further including a pressurized gas tank and an outflow conduit, and a multiple-setting valve establishing communication between the gas bag of at least one of the hydraulic cushions and either the pressurized gas tank or the outflow conduit, with the associated cylinder-and-piston cushion device being provided with switch means operative for changing the setting of the multiple-setting valve when the piston of the cylinder-and-piston cushion device reaches either of its end positions.

17. The arrangement defined in claim 13, further including an intermediate connector connecting the cylinder of one of the hydraulic cylinder-and-piston cushion devices to the associated hydraulic cushion, the intermediate connector including the parallel combination of a check valve and a branch conduit, the branch conduit including a flow restrictor and a pressure-responsive cutoff valve, and wherein the hydraulic cushion communicates via a conduit with the cylinder part of the cylinder-and-piston mover.

18. The arrangement defined in claim 1, further including in the walling of the pressure fluid tank a separating element exposed at its one side to ambient water pressure and at its other side to the pressure of the fluid in the pressure fluid tank, the separating element being shiftable to effect volume changes of the pressure fluid tank in response to changes in the difference between the tank pressure and the ambient water pressure.

19. The arrangement defined in claim 18, wherein the separating element is comprised of at least one elastic diaphragm.

20. The arrangement defined in claim 18, wherein the separating element comprises a cylinder open at both its ends and exposed at one end to ambient water and at the other end to the fluid in the pressure fluid tank, and a piston shiftable in the cylinder of the separating element.

21. The arrangement defined in claim 1, wherein the housing includes a housing chamber communicating at its lower end with the ambient water via at least one opening, whereby as the pile-driving arrangement is lowered through the water the increasing ambient water pressure will automatically compress gas trapped in the upper part of the housing chamber, and whereby as the pile-driving arrangement is lifted through the water the decreasing ambient water pressure will automatically decompress the gas trapped in the upper part of the housing chamber, and wherein the housing further includes a connecting conduit establishing communication between the housing chamber and the motion chamber and a valve in the connecting conduit for terminating such communication.

22. The arrangement defined in claim 21, wherein the housing is of double-walled construction and wherein the housing chamber is an annular chamber.

23. The arrangement defined in claim 21, wherein the housing chamber is provided at its lower end with an inflow conduit including a check valve which opens only when the ambient pressure exceeds the pressure in the housing chamber by a predetermined amount, an outflow conduit including a check valve which opens only when the pressure in the housing chamber exceeds the ambient pressure by a predetermined amount, and a pump connected to suck ambient water into the housing chamber and check valve at the outlet of such pump.

24. The arrangement defined in claim 1, wherein the housing is provided with at least one overflow conduit establishing communication between the upper and lower ends of the motion chamber.

25. The arrangement defined in claim 24, wherein the inner wall of the housing is of double-walled construction and wherein the overflow conduit is an annular space intermediate the walls of the housing and surrounding the motion chamber, the annular overflow space communicating with the upper and lower ends of the motion chamber through communication openings.

26. The arrangement defined in claim 25, wherein the upper communication openings are located spaced from the upper end of the motion chamber so as to be sealed off by the impact body during the upward movement of the latter shortly before the impact body reaches its upper end position inside the motion chamber.

27. The arrangement defined in claim 1, wherein the impact body is provided with at least one overflow conduit to permit gas in the path of the impact body to travel in opposite direction through the overflow conduit to the portion of the motion chamber located back of the impact body.

28. The arrangement defined in claim 21, wherein the connecting conduit comprises a section formed by two parallel conduit branches each containing a check valve, the check valves passing fluid in opposite respective directions, with the check valve which passes fluid from the motion chamber to the housing chamber being the more strongly biased of the check valves.

29. The arrangement defined in claim 1, wherein the housing includes an impact plate which closes off the bottom of the motion chamber and during operation rests upon the pile to be driven.

30. The arrangement defined in claim 29, wherein the housing is provided with a downward facing abutment shoulder for the upper side of the impact plate.

31. The arrangment defined in claim 30, further including an annular seal confined between the impact plate and the abutment shoulder and provided on one of the latter.

32. The arrangement defined in claim 30, the peripheral surface of the impact body being separated from the surrounding portion of the housing by an intermediate annular space, further including a plurality of annular seals confined between the impact plate and the abutment shoulder and defining annular spaces, and wherein the housing is provided with an equalization conduit establishing communication between such annular spaces on the one hand and the annular space intermediate the peripheral surface of the impact body and the housing on the other hand.

33. The arrangement defined in claim 29, wherein the impact plate contains at least one outflow conduit whose ends are so located as to establish communication between the interior of a hollow pile upon which the impact plate rests and the space surrounding such a pile.

34. The arrangement defined in claim 29, wherein the housing above the impact plate is provided with an upward facing annular shoulder provided with an annular seal and a downward facing annular shoulder provided with an annular seal and further including an anvil cooperating with the impact plate and having an annular flange located intermediate the upward and downward facing annular shoulders and alternately pressing against one and then the other of the annular seals.

35. The arrangement defined in claim 29, wherein the housing is provided with an annular guide casing which extends downward past the impact plate to surround the pile to be driven, with the guide casing confining a body of air when the pile-driving arrangement is lowered into the water, the body of air serving as an air cushion.

36. The arrangement defined in claim 21, wherein the housing includes an impact plate which closes off the bottom of the motion chamber and during operation rests upon the pile to be driven, wherein the housing is provided with an annular guide casing which extends downward past the impact plate to surround the pile to be driven, with the guide casing confining a body of air when the pile-driving arrangement is lowered into the water, the body of air serving as an air cushion, and wherein the housing chamber extends to the bottom of the guide casing.

37. The arrangement defined in claim 36, wherein the guide casing is removably secured to the remainder of the housing.

38. The arrangement defined in claim 36, wherein the drive unit is provided with a buoyancy tank having a bouyant force exceeding the weight of the entire drive unit, so that when the pile-driving arrangement is underwater the drive unit floats above the housing, and further including a flexible conduit establishing communication between the interiors of the buoyancy tank and of the housing chamber.

39. The arrangement defined in claim 38, wherein the flexible conduit includes a normally open pressure-responsive valve which closes when the pressure in the buoyancy tank exceeds a predetermined value.

40. The arrangement defined in claim 39, wherein the buoyancy tank is provided with an outflow conduit having a check valve which opens to permit outflow of buoyancy gas only when the internal pressure of the buoyancy tank reaches a predetermined value.

41. The arrangement defined in claim 24, wherein the housing is provided with a normally closed water-pressure-controlled valve and a pressurized gas conduit leading from the water-pressure-controlled valve to the motion chamber.

42. The arrangement defined in claim 41, wherein the water-pressure-controlled valve is provided with a diaphragm exposed at its one side to the ambient water pressure and at its other side to the gas pressure in the pressurized gas conduit for opening the water-pressure-controlled valve when the ambient water pressure exceeds such gas pressure by a predetermined amount.

43. The arrangement defined in claim 41, further including a pressurized gas tank arranged on the housing or on the drive unit and communicating with the normally closed water-pressure-controlled valve.

44. The arrangement defined in claim 41, further including a source of pressurized gas located above water and a long and thin pressurized gas conduit leading from the source to the normally opem water-pressure-responsive valve.

45. The arrangement defined in claim 44, wherein the drive motor of the drive unit is an electric motor having an electric cable leading to the surface of the water and wherein the long and thin pressurized gas conduit leading to the water-pressure-responsive valve is incorporated in the electric cable.

46. The arrangement defined in claim 41, wherein the housing is provided with a through-pass conduit establishing communication between the normally closed water-pressure-responsive valve and the space located beneath the impact body.

47. The arrangement defined in claim 41, wherein the opening of the pressurized gas conduit into the motion chamber is closed off by the impact body when the housing rests on the pile to be driven.

48. The arrangement defined in claim 46, further including a changeover valve for alternatively connecting the water-pressure-responsive valve to either the pressurized gas conduit or the through-pass conduit.

49. The arrangement defined in claim 1, wherein the housing is provided with an impact plate which closes off the bottom of the motion chamber and confines beneath the impact plate a body of air when the pile-driving arrangement is submerged, the body of air serving as an air cushion, wherein the housing is provided with a bore establishing communication between the motion chamber and the space beneath the impact plate.

50. The arrangement defined in claim 49, wherein the bore is composed of flow restrictor sections alternating with accumulator sections of larger crosssectional area.

51. A pile-driving arrangement for driving piles both above and below water, comprising, in combination, a housing containing a gas-filled motion chamber; an impact body movable upward and downward in the motion chamber; a cylinder-and-piston mover comprised of a cylinder part and a piston part, one part being connected with the housing and the other part with the impact body for effecting relative movement between the impact body and the housing; a drive unit on the housing, and drive unit including a drive motor, a pressure fluid pump driven by the drive motor, and a pressure fluid tank; connecting means connecting the drive unit with the housing for limited movability relative to the housing; and means interconnecting the cylinder part and the pressure fluid pump including flexible conduits leading from the pump to the opposite working chambers of the cylinder part and a direction-changing device for controlling fluid flow through the conduits wherein the housing includes a housing chamber communicating at its lower end with the ambient water via at least one opening, whereby as the pile-driving arrangement is lowered through the water the increasing ambient water pressure will automatically compress gas trapped in the upperpart of the housing chamber, and whereby as the pile-driving arrangement is lifted through the water the decreasing ambient water pressure will automatically decompress the gas trapped in the upper part of the housing chamber, and wherein the housing further includes a connecting conduit establishing communication between the housing chamber and the motion chamber and a valve in the connecting conduit for terminating such communication.

* * * * *